United States Patent [19]

Fukui

[11] Patent Number: 4,936,567

[45] Date of Patent: Jun. 26, 1990

[54] SHEET TRANSPORT APPARATUS

[75] Inventor: Kazuyuki Fukui, Osaka, Japan

[73] Assignee: Minolta Camera Kabushiki Kaisha, Osaka, Japan

[21] Appl. No.: 350,918

[22] Filed: May 12, 1989

Related U.S. Application Data

[63] Continuation of Ser. No. 164,893, Mar. 7, 1988, abandoned.

[30] Foreign Application Priority Data

Mar. 9, 1987 [JP] Japan ..... 62-53763

[51] Int. Cl.[5] ..... B65H 7/00; B65H 9/00

[52] U.S. Cl. ..... 271/246; 271/266; 271/265

[56] References Cited

U.S. PATENT DOCUMENTS

| | | | |
|---|---|---|---|
| 4,025,187 | 5/1977 | Taylor et al. | 271/245 |
| 4,078,790 | 3/1978 | Stocker | 271/246 |
| 4,135,804 | 1/1979 | Schoppe et al. | 271/245 |
| 4,203,588 | 5/1980 | Joosten | 271/246 |
| 4,465,272 | 8/1984 | Kajita et al. | 271/246 |
| 4,645,195 | 2/1987 | Scranton et al. | 271/245 |

FOREIGN PATENT DOCUMENTS 59-50936 4/1984 Japan .

*Primary Examiner*—Michael S. Huppert
*Assistant Examiner*—Steven Reiss
*Attorney, Agent, or Firm*—Burns, Doane, Swecker & Mathis

[57] ABSTRACT

A sheet transport apparatus comprising a gate for opening and closing a transport path to stop the movement of the front end of the sheet and guide plate for pressing down a loop of the sheet. The front end of the transported sheet comes to contact with the gate to form a loop on the upstream side of the gate. Then, when the transport path is opened by the gate, the guide plate depresses the loop towards the direction of the transport to cause the front end of the sheet to move forward aided by the stiffness of the sheet itself.

13 Claims, 6 Drawing Sheets

SHEET TRANSPORT APPARATUS

This application is a continuation, of application Ser. No. 07/164,893, filed Mar. 7, 1988, now abandoned.

BACKGROUND OF THE INVENTION

1. Field of the Invention

The present invention relates to a sheet transport apparatus particularly one capable of starting the transport of the sheet from stand-by position, on which the sheet sent out from a sheet stocker is temporarily stopped at a predetermined and synchronized timing.

2. Description of Related Art

In general, the transfer type copying machine has a sheet transport system wherein a copying sheet, which is sent out one by one from a sheet stocker and put to a stand-by position once by a register device, is transported to the copying unit in response to the synchronizing signal for synchronizing the transport of the sheet with the formation of the toner image on the photosensitive drum. Such sheet transport system is required to comprise the register device which permits the sheet to be transported to the copying unit accurately at the synchronized timing and also required to have the function to correct the skewing of the sheet.

For the prior art, the gate register system comprising a plate-form gate serving as a register member and installed so as to be able to open and close the sheet transport path is known publicly as described in Japanese Patent Laid Open Publication No. 59-50936.

In said gate register system, however, the front end of the sheet in contact with the gate is apt to slip to cause the delay of synchronization timing in spite of its excellent skew-corrective function, and the higher the operating speed (sheet transport speed) of the system or the smaller the stiffness of the sheet, the greater the delay of synchronization timing. More specifically, when the gate is opened in response to the synchronizing signal, the sheet is made to move forward due to the force of the loop of the sheet formed on the upstream side of the gate in the direction of the transport, but, if the stiffness of the sheet is not large enough, the forward movement of the sheet is not able to follow the speed of the sheet transport system.

SUMMARY OF THE INVENTION

Accordingly, it is an object of the present invention to provide a sheet transport apparatus which is not only capable of surely correcting the skewing of the sheet and enabling the front end of the sheet to acquire an increased force for the forward movement when the sheet transport path of the gate member is opened, regardless of whether the stiffness of the sheet is relatively small or the transport speed is relatively high, but also capable of accurately making the synchronization of the timing when resuming the transport of the sheet after the stop.

To realize the above object, a sheet transport apparatus according to the present invention in which a sheet to be transported along a sheet transport path is once put to a stand-by position so that the transport is resumed at a predetermined timing, the apparatus comprises a gate member for opening and closing the sheet transport path to stop the movement of the front end of the sheet once to cause the sheet to form a loop on the upstream side of the gate member in the direction of the transport and means for pressing down the loop of the sheet simultaneously with the opening action of the gate member in order to enable the looped sheet to move forward in the direction of transport due to the stiffness of the sheet itself when depressed from above.

Further, a sheet transport apparatus according to the present invention in which a sheet to be transported along a sheet transport path is once put to a stand-by position so that the transport is resumed at a predetermined timing, the apparatus comprises a gate member for opening and closing the sheet transport path to stop the movement of the front end of the sheet once, a transport roller located on the upstream side of the gate member in the direction of the transport for transporting the sheet towards the gate member, controlling means for enabling the transport roller to continue the transport of the sheet for a predetermined period of time even when the movement of the front end of the sheet is stopped by the closing action of the gate member to cause the sheet to form a loop between the gate member and the transport roller, sheet guide means located between the gate member and the transport roller and capable of moving between a first point where the form of the sheet loop is limited when the sheet forms the loop and a second point where the loop of the sheet is depressed and means for enabling the sheet guide means to move to the second point when the sheet transport path is opened by the gate member.

According to the present invention, the front end of the transported sheet first comes into contact with the gate member to form a loop on the upstream side of the gate member in the direction of the transport, whereby the skew of the sheet is corrected. Then, when the sheet transport path is opened by the gate member, the sheet guide means depresses the loop towards the direction of the transport to cause the front end of the sheet to move forward aided by the stiffness of the sheet itself, whereby the follow-up speed of the sheet can be increased.

BRIEF DESCRIPTION OF THE DRAWINGS

These and other objects and features of the present invention will become apparent from the following description taken in conjunction with the preferred embodiments thereof with the reference of the accompany drawings, in which:

FIG. 1 through FIG. 5 show a first embodiment of the present invention;

FIG. 1 is an elevational view showing a condition when a gate solenoid is turned off;

FIG. 2 is an elevational view showing a condition when the gate solenoid is turned on;

FIG. 4 is a block diagram of a control circuit;

FIG. 5 is a time chart showing an operation;

DETAILED DESCRIPTION OF THE PREFERRED EMBODIMENTS

[First Embodiment, Refer to FIG. 1 through FIG. 5]

Figure 1:
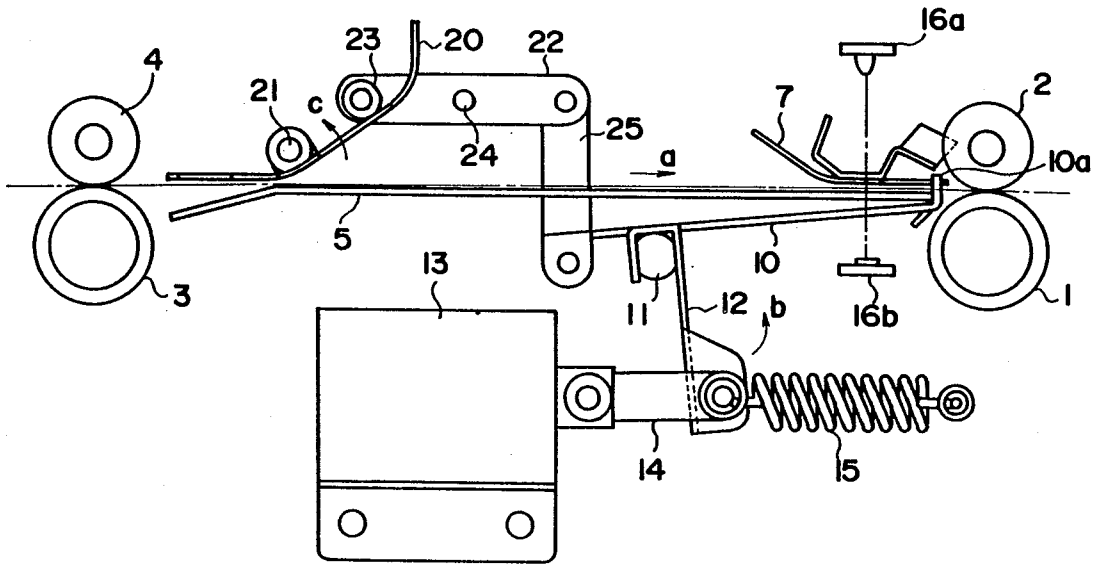
Figure 2:
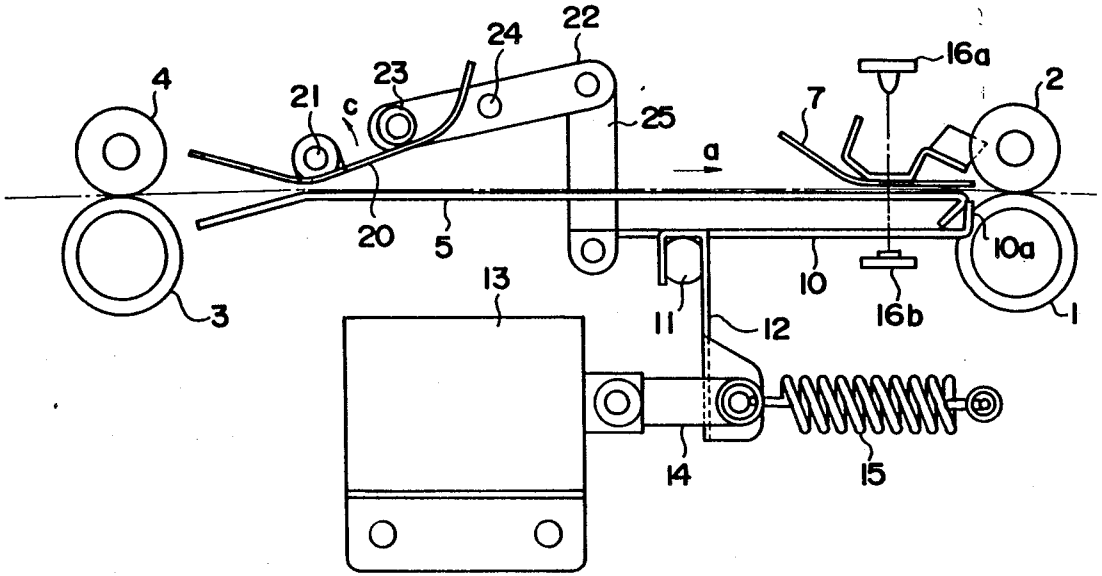

In FIG. 1 and FIG. 2, a sheet transport path indicated with the chain line contains a pair of register rollers 1 and 2, transport rollers 3 and 4, a lower guide plate 5, an upper guide plate 7, a gate 10 and a sheet guide plate 20. The sheet is transported towards the direction of an arrow a. A sheet stocker (not shown in the drawing) is located on the upstream side of the transport rollers 3 and 4. The transfer portion of the copying machine is located on the downstream side of the register rollers 1 and 2.

For the register rollers 1 and 2 and the transport rollers 3 and 4, the lower rollers 1 and 3 are rotated towards the direction of the transport of the sheet when clutches are turned on respectively at the timings which will be explained in the following, while the upper rollers 2 and 4 are accordingly rotated by the rotation of the lower rollers 1 and 3. The gate 10 can move in up and down directions on a supporting shaft 11 which serves as a supporting point, while a gate portion 10*a* moves simultaneously with the up-and-down motion of the gate 10 to open and close the sheet transport path immediately before the register rollers 1 and 2. The supporting shaft 11 is provided with a lever 12, and the lower end of the lever 12 is not only connected to a plunger 14 of a solenoid 13 through a link 14 but also constantly pushed towards the direction of an arrow b centering around the supporting shaft 11 by a coil spring 15. The sheet guide plate 20 is movably supported with the supporting shaft 21 and constantly forced towards the direction of arrow c with an elastic member (not shown in the drawing) to contact with a roller 23 provided at an end of an intermediate lever 22. The intermediate lever 22 can move freely around a supporting shaft 24 which serves as a supporting point and is connected to another intermediate lever 25 which is connected to the rear end of the gate 10.

The solenoid 13 is always kept in off-condition, and, as shown in FIG. 1, the gate 10 and the lever 12 are forced towards the direction of the arrow b by the coil spring 15 to cause the gate portion 10*a* to close the sheet transport path. The lever 22 is kept almost level, and the sheet guide plate 20 turns in the direction of the arrow c. When the solenoid 13 is put to on-position at the timing described in the following, the gate 10 and the lever 12 displace to cause the gate portion 10*a* to open the sheet transport path as shown in FIG. 2. Simultaneously, the lever 25 rises slightly, and the lever 22 turns in the counterclockwise direction around the supporting shaft 24 which serves as a supporting point. Then, the sheet guide plate 20 rotates slightly around the supporting shaft 21 which serves as a supporting point in the reverse direction to the arrow c.

Sensors (optically coupled elements 16*a* and 16*b*) for detecting the presence of the sheet in transport are located on the upstream side of the gate portion 10*a*.

Figure 4:
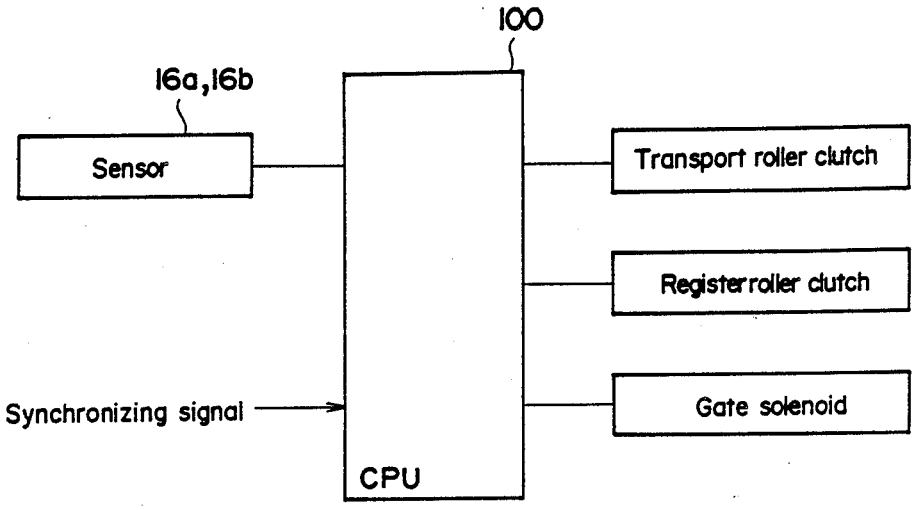

The sheet transport apparatus having the above-described composition is mainly controlled by a microcomputer as shown in FIG. 4. The input port of the microcomputer accepts the sheet detection signal to recognize the front end and the rear end of the sheet and the synchronizing signal to give the command for resuming the transport of the sheet, while the output port outputs the drive signal to the register roller clutch.

Next, the operation of the sheet transport apparatus will be explained in reference to FIGS. 3A, 3B, 3C and 3D and FIG. 5.

Figure 3A:
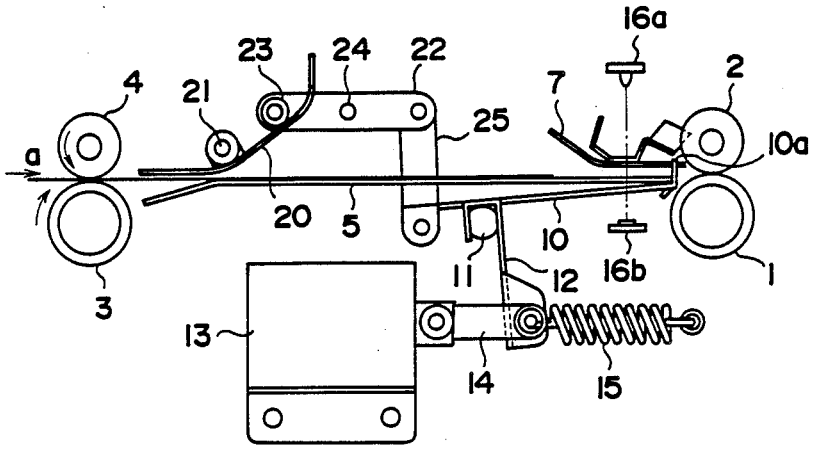
FIGS. 3A, 3B, 3C and 3D are explanatory drawings showing an operation.
Figure 3B:
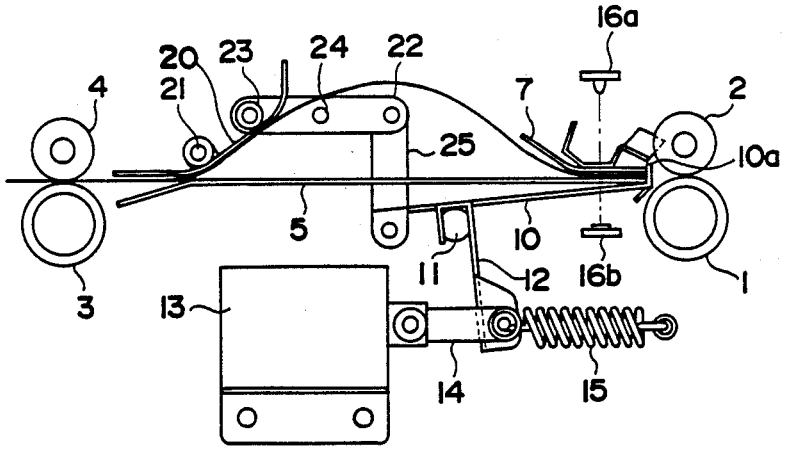

First, when the sheet is fed, the transport roller clutch is put to on-position, and the sheet is transported along the lower guide plate 5 in the direction of the arrow a by the transport rollers 3 and 4 (refer to FIG. 3A).

When the front end of the sheet is detected by the sensors 16*a* and 16*b*, and the time T1 has passed, the transport roller clutch is put to off-position. For the time T1, the front end of the sheet comes into contact with the gate portion 10*a* and the sheet forms a loop on the lower guide plate 5 by the rotation of the transport rollers 3 and 4 (refer to FIG. 3B). At this point, the skew of the sheet is corrected, if any, since the sheet is forced to slide in lateral direction when the front end of the sheet comes into contact with the gate portion 10*a* to accomplish the alignment of the sheet. The form of the sheet loop is limited by the sheet guide plate 20.

Figure 3C:
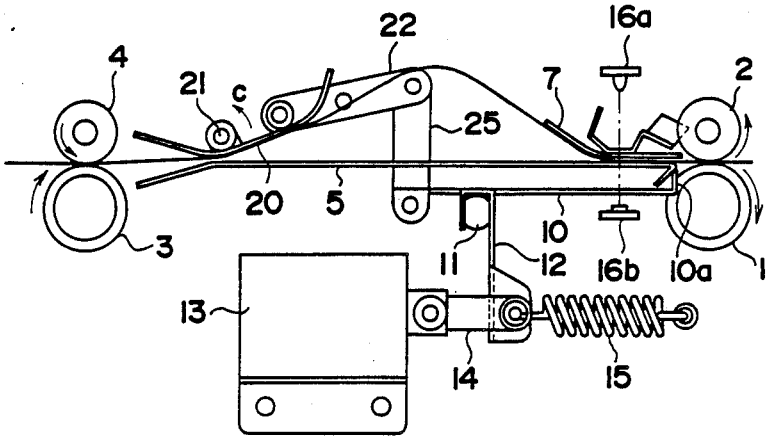
Figure 3D:
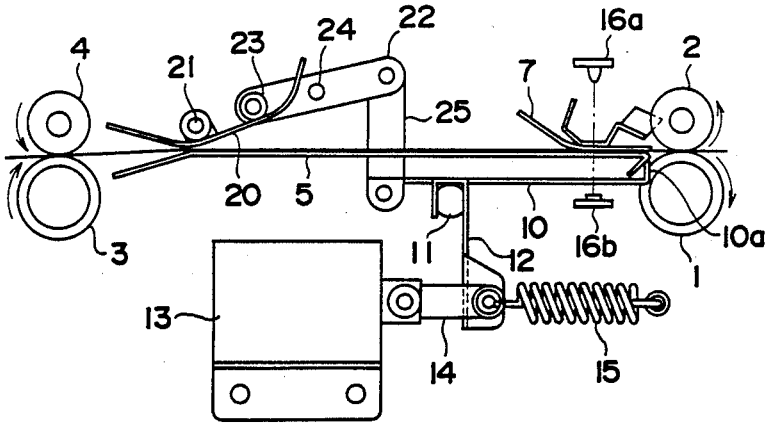

Then, when the synchronizing signal is turned on at the predetermined timing, the solenoid 13 is put to on-position, and this causes the register roller clutch and the transport roller clutch are put to on-position respectively (refer to FIG. 3C). This causes the gate portion 10*a* to open the sheet transport path, and the sheet guide plate 20 moves in the reverse direction to the direction of the arrow c to push the sheet loop. The front end of the sheet moves forward due to the spring-back force of the sheet loop coupled with the pushing force of the sheet guide plate 20 given to the downstream side of the sheet rather than the top of the sheet loop and forced to enter between the register rollers 1 and 2 which have just started to turn in order to be transported to the transfer portion (refer to FIG. 3D).

Then, when the rear end of the sheet is detected by the sensors 16*a* and 16*b*, the transport roller clutch is put to off-position, and when the time T2 has passed, and the rear end of the sheet has passed the register rollers 1 and 2, the solenoid 13 and the register roller clutch are put to off-position respectively to return to the initial position.

In the first embodiment of the present invention, the front end of the sheet first comes into contact with the gate portion 10*a* where the sheet is forced to slide in lateral direction to correct the skew of the sheet, if any. The follow-up of the sheet movement to the synchronizing signal is good enough, since the sheet loop is pushed by the sheet guide plate 20 when the sheet transport path is opened by the gate portion 10*a* following the reception of the synchronizing signal, and this gives a large forward moving force to the sheet, whereby the delay in synchronization timing can be prevented even when the elasticity or stiffness of the sheet is relatively small and the transport speed is relatively high.

Figure 6:
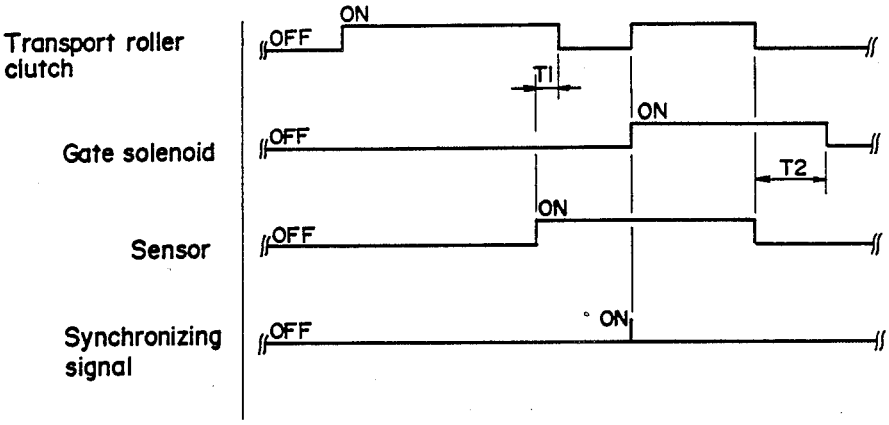
FIG. 6 is a time chart showing an operation of a second embodiment of the present invention.

[Second Embodiment, Refer to FIG. 6]

In this second embodiment, the clutch for the lower register roller 1 is omitted, though the rest of the constituent parts remain unchanged from the case of the above mentioned first embodiment. For the operation of the sheet transport apparatus according to this second embodiment, the register rollers 1 and 2 are kept rotating at all times, and the operations illustrated in FIG. 6 are the same as those operations shown in FIG. 5. More particularly, in the case of the second embodiment, when the synchronizing signal is given, the gate portion 10*a* causes the sheet transport path to open, and the front end of the sheet is forced to enter between the register rollers 1 and 2 for transport due to the pushing force given by the sheet guide plate 20.

Figure 7:
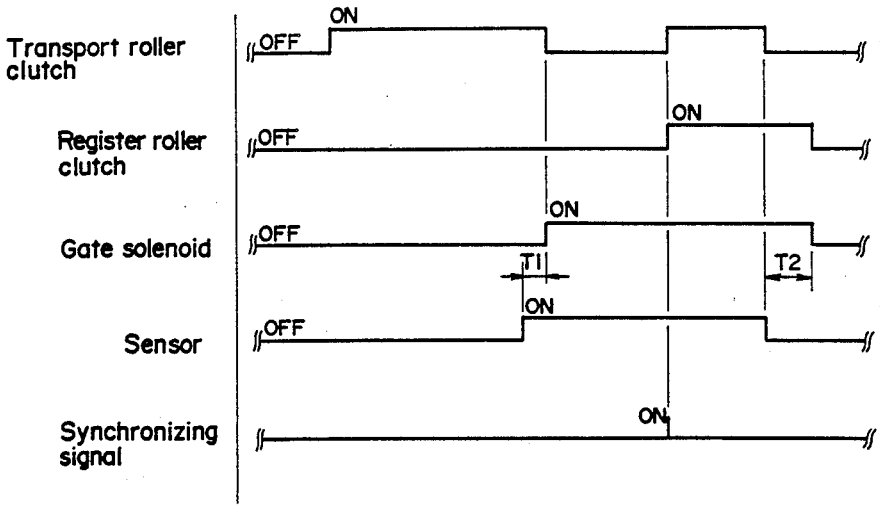
FIG. 7 is a time chart showing an operation of a third embodiment of the present invention.

[Third Embodiment, Refer to FIG. 7]

Figure 5:
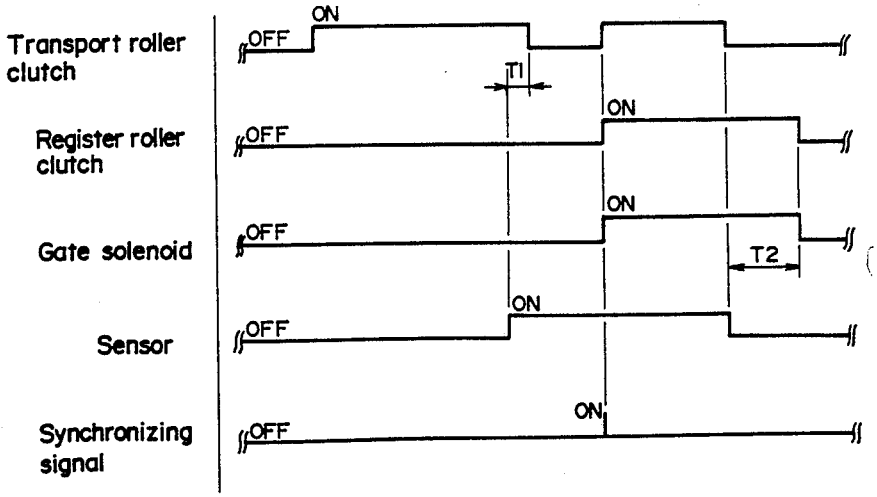

The composition of the sheet transport apparatus according to the third embodiment is basically the same as that of the first embodiment except the timing of the operation by the control device which differs slightly from that in the case of the first embodiment as illustrated in FIG. 5.

More particularly, when the front end of the sheet is detected by the sensors 16*a* and 16*b*, and the time T1 has passed, the transport roller clutch is put to off-position, and the solenoid 13 is turned on. For the time T1, the sheet forms a loop on the upstream side of the gate portion 10a to correct the skew thereof. Then, the front end of the sheet moves forward due to the stiffness of the sheet itself coupled with the pushing force of the sheet guide plate 20 to enter into the nipping portion between the register rollers 1 and 2 which are standing still when the sheet transport path is caused to open by the gate portion 10a. Then, when the synchronizing signal is given, the register roller clutch and the transport roller clutch are put to on-position respectively to permit the sheet to be transported to the copying unit.

In the third embodiment, the pushing force of the sheet guide plate 20 is used exclusively for enabling the front end of the sheet to enter between the register rollers 1 and 2 accurately. The timing synchronized with the resumption of the transport of the sheet can be determined by putting the register rollers 1 and 2 to on-position respectively. As described in the foregoing, in the case of the register method using the rollers, the transport of the sheet starts from the point where the front end of the sheet is between the register rollers 1 and 2, and so the movement of the sheet satisfactorily follows the synchronizing signal, thereby eliminating the chances of the delay of synchronization.

Although the present invention has described in connection with the preferred embodiments thereof, it is to be noted that various changes and modifications are apparent to those skilled in the art. Such changes and modifications are to be understood as included within the scope of the present invention as defined by the appended claims, unless they depart therefrom.

What is claimed is:

1. A sheet transport apparatus in which a sheet to be transported along a sheet transport path is put to a stand-by position so that the transport is resumed at a predetermined timing, said apparatus comprising:

a gate member for opening and closing said sheet transport path to intercept the front end of the sheet to cause the sheet to form a loop on the upstream side of said gate member in the direction of the transport; and means for initiating a downward force on the loop of the sheet at a point on the loop that is closer to the upstream side of the loop in the direction of the transport than the top of the loop simultaneously with the opening action of said gate member in order to enable the looped sheet to move forward in the direction of transport due to the stiffness of the sheet itself when depressed from above;

wherein said means for initiating a downward force moves from a first position to a lower second position relative to said transport path.

2. A sheet transport apparatus as claimed in claim 1, wherein said gate member is pivotably provided between a point where said sheet transport path is closed and a point where said sheet transport path is opened.

3. A sheet transport apparatus as claimed in claim 2, wherein said pressing means takes the form of a plate which is so moved as to depress the looped sheet from above.

4. A sheet transport apparatus as claimed in claim 3, wherein said pressing means comprises a link mechanism connected with said gate member so that said pressing means depresses the sheet simultaneously with the opening action of said gate member.

5. A sheet transport apparatus in which a sheet to be transported along a sheet transport path is once put to a stand-by position so that the transport is resumed at a predetermined timing, said apparatus comprising:

a gate member for opening and closing said sheet transport path to intercept the front end of the sheet;

a transport roller located upstream of said gate member in the direction of the transport for transporting the sheet towards said gate member;

controlling means for enabling said transport roller to continue the transport of the sheet for a predetermined period of time after the movement of the front end of the sheet is stopped by the closing action of said gate member to cause the sheet to form a loop between said gate member and said transport roller;

sheet guide means located between said gate member and said transport roller and capable of moving between a first position which enables said sheet to form a loop of a first size and a second position wherein the sheet guide means contacts the loop at a location closer to the upstream side of the loop of the sheet, in the direction of the transport, than the top of the loop, at which second position the size of the loop of the sheet is smaller than the first size; and means for initiating a downward force on the sheet guide means to move said sheet guide means to said second position when said sheet transport path is opened by said gate member.

6. A sheet transport apparatus as claimed in claim 5, wherein said gate member is pivotably provided between a point where said sheet transport path is closed and a point where said sheet transport path is opened.

7. A sheet transport apparatus as claimed in claim 6, wherein said sheet guide means takes the form of a plate which is so moved as to depress the looped sheet from above.

8. A sheet transport apparatus as claimed in claim 7, wherein said enabling comprises a link mechanism connected with said gate member so that said sheet guide means depresses the sheet simultaneously with the opening action of said gate member.

9. A sheet transport apparatus in which a sheet to be transported along a sheet transport path is once put to a stand-by position so that the transport is resumed at a predetermined timing represented by a synchronizing signal, said apparatus comprising:

a gate member for opening and closing said sheet transport path to intercept the front end of the sheet;

a transport roller located upstream of said gate member in the direction of the transport for transporting the sheet towards said gate member;

first controlling means for enabling said transport roller to continue the transport of the sheet for a predetermined period of time after the movement of the front end of the sheet is stopped by the closing action of said gate member to cause the sheet to form a loop between said gate member and said transport roller;

a pair of register rollers located downstream of said gate member in the direction of the transport;

sheet guide means located between said gate member and said transport roller and capable of moving between a first position which enables said sheet to form a loop of a first size and a second position wherein the sheet guide means contacts the loop of the sheet so as to depress the loop;

second controlling means for opening said gate member and for moving said sheet guide means from the first position to said second position after the formation of the sheet loop by said first controlling means, so that the front end of the sheet comes into contact with the nipping portion of said pair of register rollers while said pair of register rollers is at rest; and third controlling means for rotating said pair of register rollers in response to the synchronizing signal.

10. A sheet transport apparatus as claimed ian claim 9, further comprising means for detecting the sheet upstream of said gate member in the direction of the transport.

11. A sheet transport apparatus as claimed in claim 10, wherein said first controlling means stops the rotation of said transport roller after a predetermined period of time from the time when the front end of the sheet is detected by said detecting means.

12. A sheet transport apparatus as claimed in claim 10, wherein said second controlling means enables said gate member to open said sheet transport path and said sheet guide means to move to said second point after a predetermined period of time from the time when the front end of the sheet is detected by said detecting means.

13. A sheet transport apparatus as claimed in claim 10, further comprising fourth controlling means for stopping the rotation of said transport roller when the rear end of the sheet is detected by said detecting means, for stopping the rotation of said pair of register rollers, for letting said gate member to return to the position where said sheet transport path is closed and for enabling said sheet guide means to return to said first point after a predetermined period of time from the time of the detection of the rear end of the sheet by said detecting means.

* * * * *